US005257869A

United States Patent [19]

Yoshikawa

[11] Patent Number: 5,257,869

[45] Date of Patent: Nov. 2, 1993

[54] PRINT CARRIAGE POSITIONING WITH NORMAL AND PRECISION MODES

[75] Inventor: Junichi Yoshikawa, Yokohama, Japan

[73] Assignee: Canon Kabushiki Kaisha, Tokyo, Japan

[21] Appl. No.: 940,760

[22] Filed: Sep. 8, 1992

Related U.S. Application Data

[63] Continuation of Ser. No. 825,775, Jan. 21, 1992, abandoned, which is a continuation of Ser. No. 492,412, Mar. 5, 1990, abandoned, which is a continuation of Ser. No. 146,021, Jan. 20, 1988, abandoned.

[30] Foreign Application Priority Data

Jan. 28, 1987 [JP] Japan ..... 017929

[51] Int. Cl.[5] ..... B41J 19/30

[52] U.S. Cl. ..... 400/304; 400/279; 400/322

[58] Field of Search ..... 400/210, 279, 303, 304, 400/320, 322, 695, 1, 697.1, 903

[56] References Cited

U.S. PATENT DOCUMENTS

| | | | |
|---|---|---|---|
| 4,203,678 | 5/1980 | Nordstrom | 400/903 X |
| 4,388,005 | 6/1983 | Wehking et al. | 440/144.2 |
| 4,688,956 | 8/1987 | Miyake | 400/322 X |
| 4,693,618 | 9/1987 | Hanagata | 400/322 X |
| 4,758,104 | 7/1988 | Fujiwara | 400/303 |

OTHER PUBLICATIONS

*IBM Tech. Disc. Bulletin*, vol. 28, No. 12, May 1986, pp. 5599-5600, 400-903.

*Primary Examiner*—David A. Wiecking
*Assistant Examiner*—Steven S. Kelley
*Attorney, Agent, or Firm*—Fitzpatrick, Cella, Harper & Scinto

[57] ABSTRACT

In a typewriting apparatus in the invention, the carrier is driven by a stepping motor. Characters printed by this apparatus are divided into two groups, one for characters frequently used but requiring no higher printing position precision and the other for characters less frequently used but requiring higher printing position precision. Furthermore, each group can be printed in a normal printing mode or in a boldface printing mode. These four kinds of printing are executed by selecting their respective suitable pulse rates of the stepping motor.

4 Claims, 4 Drawing Sheets

PRINT CARRIAGE POSITIONING WITH NORMAL AND PRECISION MODES

This application is a continuation of application Ser. No. 07/825,775 filed Jan. 21, 1992, now abandoned; which in turn is a continuation of Ser. No. 07/492,412 filed on Mar. 5, 1990, now abandoned, which is in turn is a continuation of Ser. No. 07/146,021 filed on Jan. 20, 1988, now abandoned.

BACKGROUND OF THE INVENTION

1. Field of the Invention

The present invention relates to a typewriting apparatus, and more particularly to a typewriting apparatus in which a carrier is driven by a stepping motor.

2. Related Background Art

In ordinary typewriters, the stepping motor for driving a carrier at printing operation is driven always with a constant control pulse rate (a constant timing of energizations of driving phases of the stepping motor) both for frequently used letters and symbols (for example, a, b, c, . . . , A, B, C, . . .) and for letters and symbols which are not frequently used but require higher positional precision (|, _etc. which show evident defects in printing such as broken or staggered line if the positional precision is not high enough), and no particular control for each letter or symbol has been made.

In the conventional typewriting apparatus, because of the above-explained reason, it has been necessary to employ such driving system and driving pulse rate that will provide sufficient precision of printing position for the above-mentioned symbols such as | and _, so that the driving system has been inevitably expensive. On the other hand, in order to reduce the cost of the driving system, ball bearings in the carrier driving system etc. are recently often replaced by sliding bearings, and such change inevitably increases hysteresis or backlash in positioning of the carrier driving system, thus significantly deteriorating the precision of printing position. In order to prevent such hysteresis or backlash, it has been proposed to regulate the pulse rate when the carrier is stopped by the stepping motor. In such method, however, since the driving system is so controlled as to push the play or backlash of the system always to one direction, the approach to a desired position has to be made slowly in order to prevent vibration at stopping, so that the control inevitably requires a longer time. Therefore, such control method, if employed in the printing of all the letters and symbols, significantly reduces the printing speed though it provides a higher precision of printing position.

SUMMARY OF THE INVENTION

An object of the present invention is to provide a typewriting apparatus utilizing different control pulse rates for driving a carrier driving stepping motor, for the letters and symbols which are frequently used and for which positional error is relatively inconspicuous (for example a, b, c, . . . , A, B, C, . . . ) and for the letters and symbols which are relatively infrequently used but require a higher precision in the printing position (|, _etc.), and effecting ordinary control to maintain the printing speed for the former group while effecting such control as to achieve a higher precision of printing position for the latter group, thereby increasing the average printing speed while improving the precision of printing position for the letters and symbols requiring such higher precision.

Another object of the present invention is to provide a typewriting apparatus capable of improving the precision of printing position for the letters and symbols requiring such higher precision, without increasing the cost of the driving system, and still maintaining a high printing speed.

DETAILED DESCRIPTION OF THE PREFERRED EMBODIMENTS

Now the present invention will be clarified in detail by an embodiment thereof shown in the attached drawings.

Figure 1:
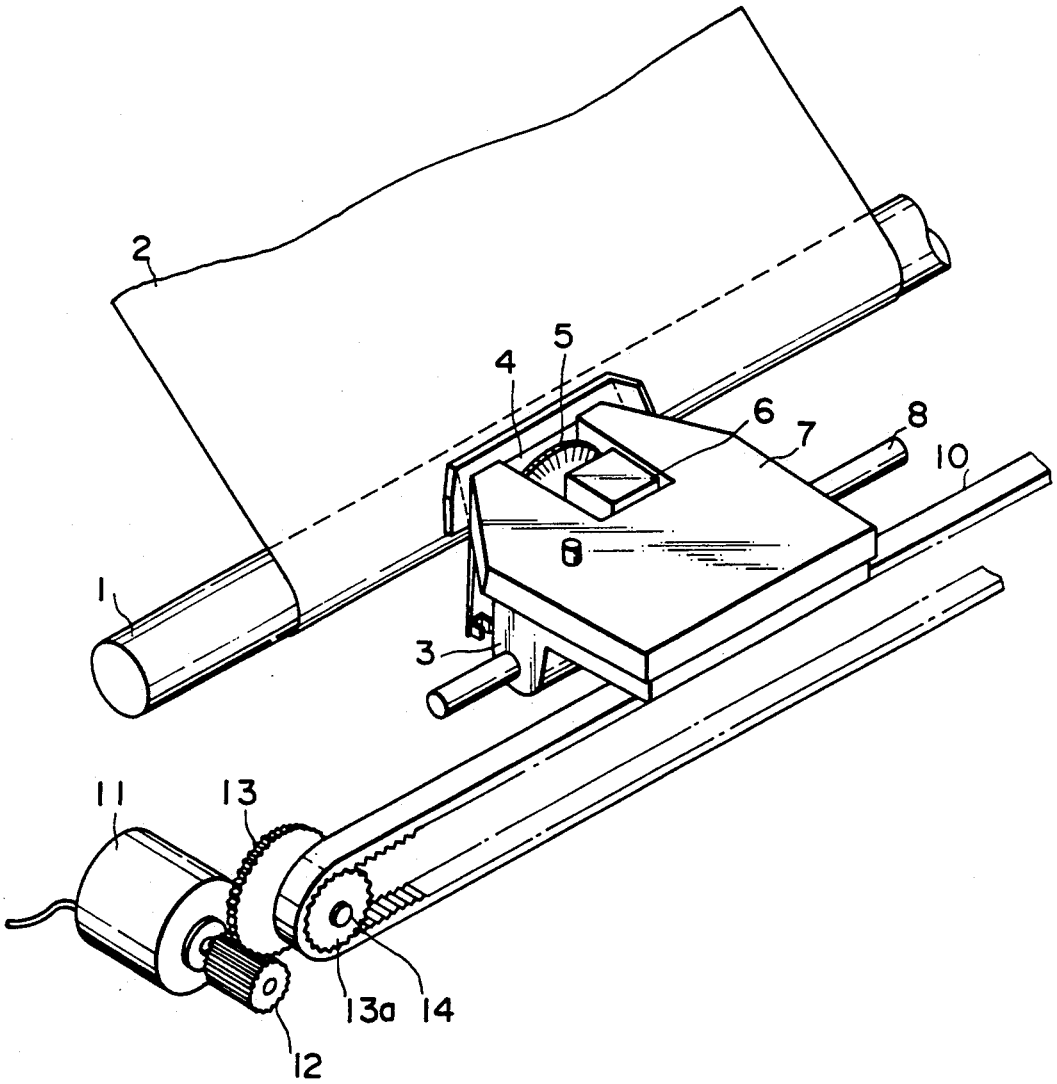
FIG. 1 is a perspective view of a printer carrier of a typewriting apparatus embodying the present invention.

FIG. 1 shows a printer carrier of a typewriting apparatus embodying the present invention. A printing hammer 6, mounted on a carrier 3 laterally reciprocating along a platen 1, hits a type wheel 5 positioned in front thereof and having printing types along the periphery thereof to form a print on a printing sheet 2 supported by the platen 1 by means of a printing ribbon 4 housed in a ribbon cassette 7. Inside the carrier 3 there are provided an unrepresented wheel motor for driving the type wheel 5 and an unrepresented ribbon motor for controlling the ribbon feeding of the ribbon cassette 7. The entire carrier 3 is guided by a shaft 8 and is connected, for driving, to belt 10 driven by a belt pulley **13*a* which is integral with a gear 13 whose speed is reduced by a pinion 12 of a stepping motor 11. The gear 13 is rotatably fitted on a shaft 14**.

Figure 2A:
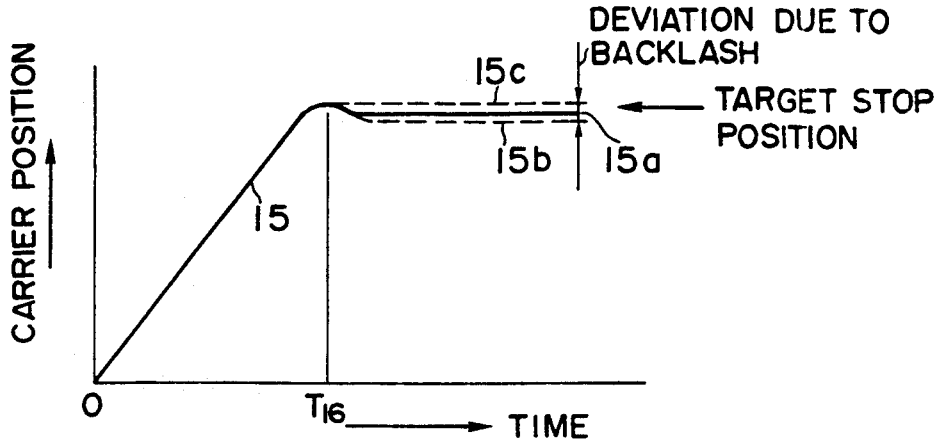
FIG. 2A is a chart showing the movement of the carrier in case of printing a letter not requiring increased precision of printing position.

The meshing between the pinion 12 and the gear 13 and the meshing between the belt pulley **13*a* and the belt 10 inevitably have certain backlashes. Also the fitting of the gear 13 on the shaft 14 does not use a ball bearing, but, for the purpose of cost reduction, the gear 13 made of a plastic material is itself used as a sliding bearing. Consequently the belt 10 cannot be given a high tension as it will increase the sliding load and friction. The resulting slack of the belt 10, in combination with the above-mentioned backlashes, gives rise to a hysteresis or deviation in the lateral positioning of the carrier 3, so that a high precision in positioning is difficult to achieve. FIG. 2A shows an example of actual carrier movement in such carrier driving system, in which ordinate indicates the carrier position while abscissa indicates time. In FIG. 2A, a curve 15** represents the movement of the carrier when it is stopped after being moved over a certain distance by the stepping motor.

Figure 2B:
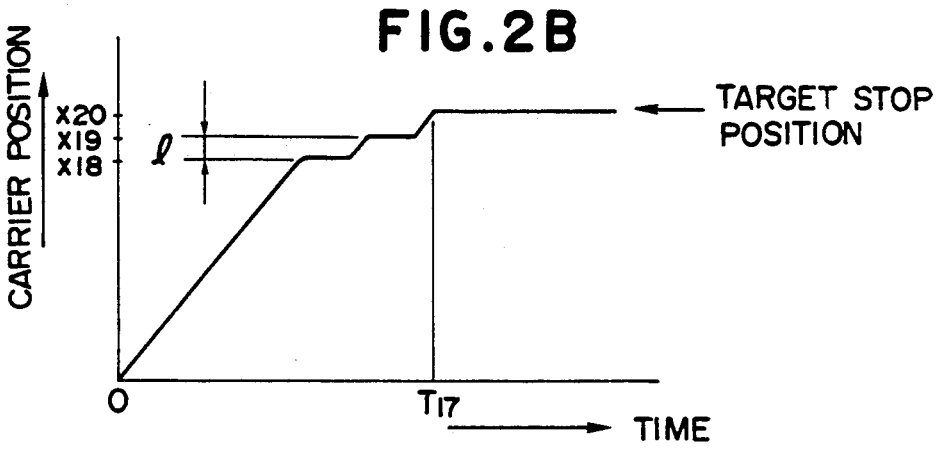
FIG. 2B is a chart showing the movement of the carrier in case of printing a letter requiring an increased precision of printing position.

In the carrier driving system has a play as explained above, the stopping position of the carrier shows deviation or fluctuation from the target stop position as indicated by curves 15*a*, 15*b* and 15*c*, and the precision of printing position is therefore deteriorated. However it has been experimentally confirmed, in the same carrier driving system, that the above-mentioned deviation can be reduced to a practically acceptable level, by a stepwise drive of the carrier in the vicinity of the target stop position, as shown in FIG. 2B, through a modification in the pulse rate of the stepping motor 11. In the illustrated example, the carrier is once stopped at a position x18 which is in front of the target stop position by two steps of the stepping motor, and is then gradually advanced to positions x19 and x20 by a step each time, wherein ( indicates the movement of the carrier caused by rotation of a step of the stepping motor. This driving method pushes the play of the driving system to one direction, thereby improving the precision of positioning of the carrier. However the time T17 required for the movement over a given distance is longer than the time T16 in the ordinary feeding method.

Figure 2C:
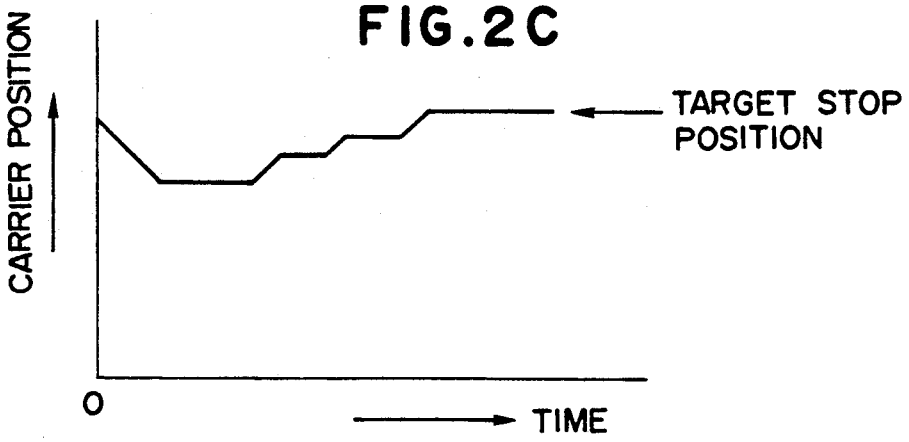
FIG. 2C is a chart showing the movement of the carrier in case an instruction is entered for printing a letter required increased precision of printing position after the carrier is stopped for printing a letter not requiring increased precision of printing position.

The printing sequence of the typewriting apparatus is classified into a case of activating the hammer for printing immediately after the quenching of the vibration following the movement of carrier to the target position, and another case of activating the hammer by a printing instruction in a state in which the carrier is already stopped at the target position. In the former case, the methods of approach shown in FIGS. 2A and 2B can be respectively used for the letter group not requiring precision of printing position and the letter group requiring precision. However, in the latter case, an instruction for printing a letter requiring increased precision of printing position may be entered after the carrier is stopped by the method shown in FIG. 2A. In such case there is adopted a control procedure shown in FIG. 2C, in which the carrier stopped in the vicinity of the target position is reversed by several steps and then forwarded by a same number of steps in gradual manner in the vicinity of the target position as shown in FIG. 2B thereby pushing the play in one direction. In this manner it is rendered possible to achieve printing with increased precision of printing position, starting from a state in which the carrier has been moved with ordinary pulse rate.

Figure 3:
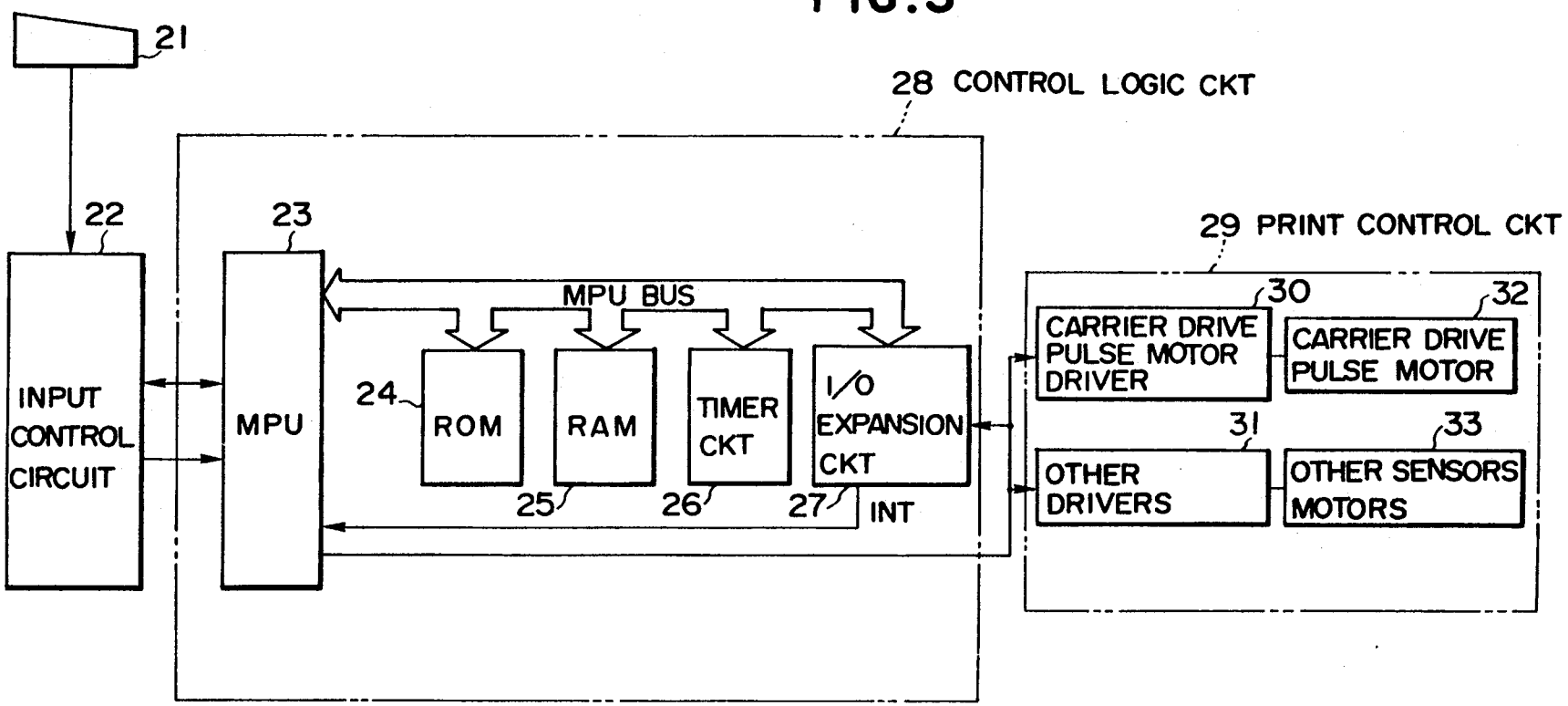
FIG. 3 is a block diagram of a typewriting apparatus embodying the present invention.

FIG. 3 is a block diagram of a typewriting apparatus embodying the present invention.

A control logic circuit 28 is composed of a microprocessing unit (MPU) 23; a read-only memory (ROM) 24; a random access memory (RAM) 25; a timer circuit 26; and an input/output expansion circuit 27, which are mutually connected by an MPU bus. In such circuit structure, the MPU 23 executes controls according to microinstructions stored in the ROM 24, thus controlling the input/output of an input control circuit 22 to which a keyboard 21 is connected. The timer circuit 26 executes generation of reference time information, measurement of elapsed time or generation of an interruption command according to a timer control condition, under the control by the MPU 23, thereby realizing real-time control of the control logic circuit 28. The ROM 24 also stores a program for the MPU 23, corresponding to a control flow chart shown in FIG. 4.

The input control circuit 22 detects the actuation of the keyboard 21 connected thereto, and sends microencoded keyboard information to the control logic circuit 28. In response said circuit 28 activates a stepping motor 32 for driving the carrier and another sensor motor 33, through drivers 30, 31 in a print control circuit 29 according to a predetermined control sequence, thereby effecting a printing operation. The RAM 25 stores the driving pulse rates corresponding to FIGS. 2A and 2B, and the character groups respectively using said pulse rates.

Figure 4:
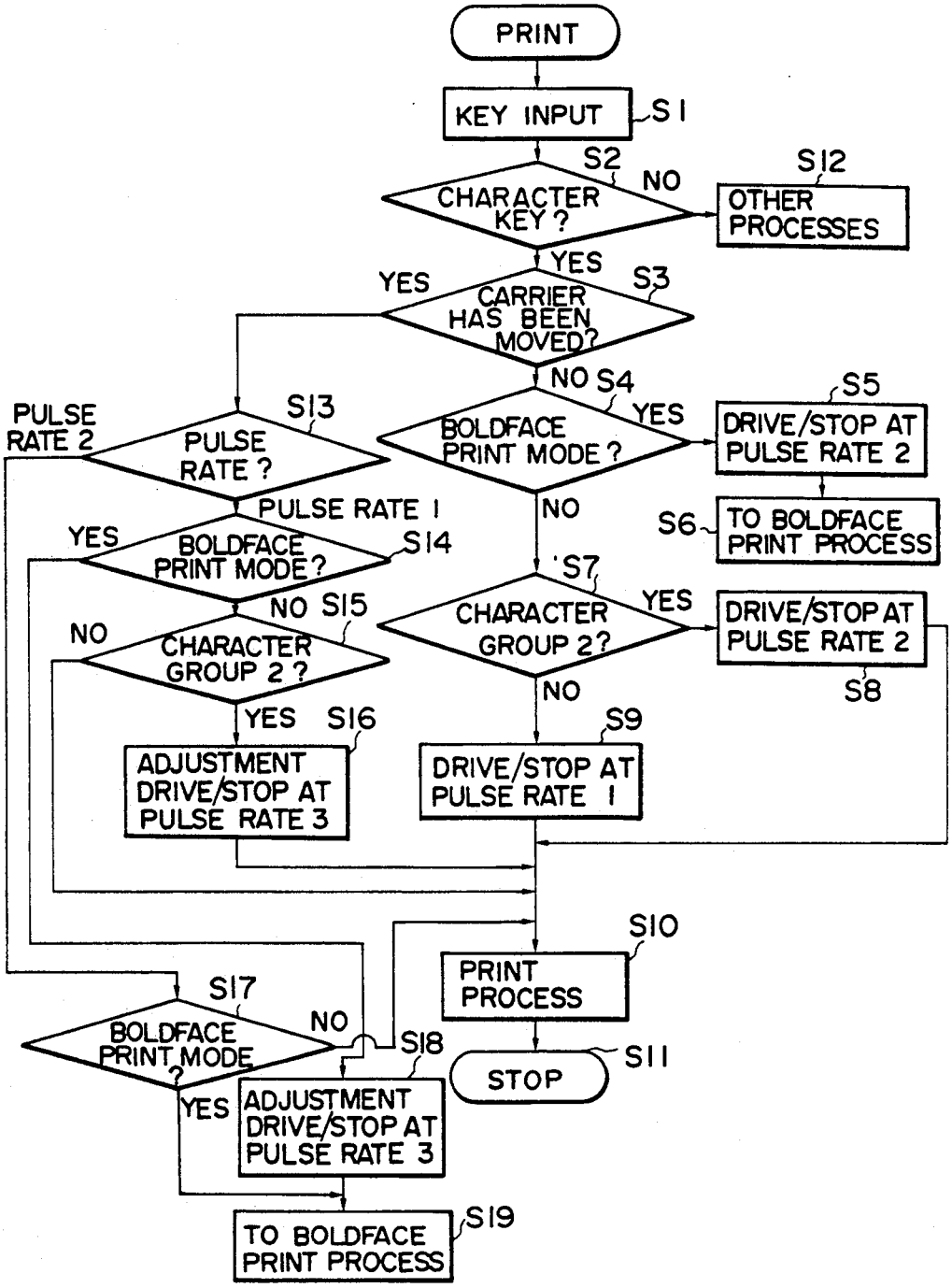
FIG. 4 is a flow chart of a print sequence in a typewriting apparatus embodying the present invention.

Now reference is made to the flow chart shown in FIG. 4, for explaining the function of the type-writing apparatus explained above. For the purpose of simplicity, the group of letters and symbols which are frequently used and of which positional error is relatively inconspicuous (for example, a, b, c, . . . , A, B, C, . . . ) will be referred to as the character group 1; the group of letters and symbols which are less frequently used but require an increased precision of printing position (for example |, _etc.) will be referred to as the character group 2; the pulse rate for stopping the carrier according to the mode shown in FIG. 2A will be referred to as the pulse rate 1; the pulse rate for stopping the carrier according to the mode in FIG. 2B as the pulse rate 2; and the pulse rate for moving and stopping the carrier according to the mode in FIG. 2C as the pulse rate 3. These data are stored in the RAM 25 in advance as explained before.

The ordinary printing method and the printing method with increased precision can also be selectively utilized for different printing modes. For example, in a bold printing mode in which a bold letter is obtained by plural hammer operations at slightly different carrier positions, a higher precision is required for the carrier position since the width of the line of the printed letter is determined by the displacements of the carrier. Therefore the pulse rate 2 is used for all the letters in such printing mode. Such printing mode can be instructed from a key in the keyboard 21.

In the flow chart shown in FIG. 4, in response to a key input from the keyboard 21 in a step S1, a step S2 discriminates whether the actuated key is a character key or another key such as a function key, and, if it is not a character key, the sequence proceeds to a step S12. On the other hand, if it is a character key, a step S3 discriminates whether the carrier has reached the target printing position, and, if not, the sequence proceeds to a step S4 for identifying the printing mode. If it is the bold printing mode, a step S5 stops the carrier with the pulse rate 2, and the sequence proceeds to a step S6 for bold printing procedure.

If the bold printing mode is not instructed, a step S7 discriminates whether the instructed character belongs to the character group 2, and, if belonging to the character group 2, a step S8 stops the carrier with the pulse rate 2, but, if not belonging to the character group 2, a step S9 stops the carrier with the pulse rate 1. Then a step S10 executes the printing operation, and the sequence is terminated at a step S11.

On the other hand, if the step S3 discriminates that the carrier has been moved, a step S13 discriminates whether the pulse rate 1 or 2 has been used in the immediately preceding carrier movement, and, if it is the pulse rate 1, a step S14 discriminates whether the bold printing mode has been instructed. If said mode has not been instructed, the sequence proceeds to a step S15 for discriminating whether the instructed character belongs to the character group 2, and, if it belongs to the group 2, a step S16 moves and stops the carrier with the pulse rate 3 before proceeding to the step S10 for the printing operation. On the other hand, if the step S15 identifies that the instructed character does not belong to the group 2, the sequence directly proceeds to the step S10.

If the step S14 discriminates the bold printing mode, a step S18 moves and stops the carrier with the pulse rate 3 and the sequence proceeds to a step S19 for bold printing process. Also if the step S13 discriminates the pulse rate 2, a step S17 discriminates whether the bold printing mode is instructed, and the sequence proceeds to the step S19 if the bold printing mode is instructed, or to the step S10 for ordinary printing process if the bold printing mode is not instructed.

As explained in the foregoing, the present invention provides an inexpensive typewriting apparatus capable of providing high print quality without sacrificing the printing speed, by selectively using different driving pulse rates for the carrier driving motor, for a group of characters which are frequently used but in which the error in position is relatively inconspicuous and a group of characters which are less frequently used but require a higher precision of printing position, and also for an ordinary printing mode and a bold printing mode.

I claim:

1. A typewriting apparatus comprising:

input means for inputting information to be printed;

discrimination means for discriminating whether the information input by said input means requires a normal degree of precision or an increased degree of precision of the printing position on a recording medium;

a carrier for supporting a printing head;

a pulse motor for moving said carrier; and control means for controlling said pulse motor such that, when said discrimination means discriminates that the information to be printed requires an increased degree of precision of the printing position, said carrier is temporarily stopped at a position in front of one or more target printing positions by a predetermined number of steps and then forwardly moved to the one or more target printing positions by repeating the forward movement and stopping of said carrier, wherein the information to be printed is printed at the target printing positions.

2. A typewriting apparatus comprising:

input means for inputting a character to be printed;

instruction means for instructing printing in a bold printing mode;

a carrier for supporting a printing head;

a pulse motor for moving said carrier; and control means for controlling said pulse motor such that, when printing in the bold printing mode is instructed by said instruction means, said carrier is temporarily stopped at a position in front of one or more target printing positions by a predetermined number of steps, and then forwardly moved to the one or more target printing positions by repeating the forward movement and stopping of said carrier, wherein the character to be printed is printed at the target printing positions.

3. A typewriting apparatus comprising:

input means for inputting information to be printed;

discrimination means for discriminating whether the information input by said input means requires a normal degree of precision or an increased precision of the printing position on a recording medium;

a carrier for supporting a printing head;

a pulse motor for moving said carrier; and control means for changing the timing of energization of the driving phases of said pulse motor and thereby controlling said pulse motor such that said carrier is moved from a position in front of one or more target printing positions by a predetermined number of steps to the target printing positions by repeating forward movement toward the target printing positions and stopping of said carrier in response to a discrimination by said discrimination means, wherein the information to be printed is printed at the target printing positions.

4. A typewriting apparatus according to claim 3, further comprising memory means for storing a variety of timings of energization of said pulse motor and a plurality of information groups each corresponding to respective one of the variety of timings.

* * * * *

UNITED STATES PATENT AND TRADEMARK OFFICE

CERTIFICATE OF CORRECTION

PATENT NO. : 5,257,869

DATED : November 2, 1993

INVENTOR(S) : JUNICHI YOSHIKAWA

It is certified that error appears in the above-indentified patent and that said Letters Patent is hereby corrected as shown below:

ON THE COVER PAGE

[30] FOREIGN APPLICATION PRIORITY DATA
"Jan. 28, 1987 [JP] Japan ..... 017929" should read --Jan. 28, 1987 [JP] Japan.....62-17929--

COLUMN 1
Line 8, "is" should be deleted.

COLUMN 2
Line 22, "required" should read --requiring--.

COLUMN 3
Line 3, "has" should read --having--.
Line 18, "(" should read --ℓ--.

COLUMN 6
Line 23, "increased" should read --increased degree of--.

Signed and Sealed this

Fifth Day of July, 1994

Bruce Lehman

BRUCE LEHMAN

*Commissioner of Patents and Trademarks*

*Attest:*

*Attesting Officer*